US008789279B2

(12) United States Patent
Samons et al.

(10) Patent No.: US 8,789,279 B2
(45) Date of Patent: Jul. 29, 2014

(54) UNITARY SAFETY SCAFFOLDING AND METHOD FOR ONE INDIVIDUAL TO INSTALL THE SAME

(76) Inventors: W. Floyd Samons, Scottsdale, AZ (US); Walter Thomas Campbell, Glendale, AZ (US)

( * ) Notice: Subject to any disclaimer, the term of this patent is extended or adjusted under 35 U.S.C. 154(b) by 51 days.

(21) Appl. No.: 13/385,858

(22) Filed: Mar. 9, 2012

(65) Prior Publication Data

US 2012/0317778 A1 Dec. 20, 2012

Related U.S. Application Data

(60) Provisional application No. 61/634,218, filed on Feb. 24, 2012.

(51) Int. Cl.
*B21D 47/00* (2006.01)

(52) U.S. Cl.
USPC ..... 29/897.3; 248/243

(58) Field of Classification Search
USPC ..... 29/897.3; 182/82
See application file for complete search history.

(56) References Cited

U.S. PATENT DOCUMENTS

| | | | | |
|---|---|---|---|---|
| 2,121,704 | A * | 6/1938 | Leeworthy | 248/235 |
| 3,134,567 | A * | 5/1964 | Shoemaker | 248/243 |
| 4,029,173 | A * | 6/1977 | Wakabayashi | 182/150 |
| 4,909,350 | A * | 3/1990 | Jacobs | 182/82 |
| 6,003,630 | A * | 12/1999 | Whalen | 182/82 |
| 6,367,754 | B1 * | 4/2002 | Cinker | 248/228.1 |
| 6,983,824 | B1 * | 1/2006 | Dandurand | 182/82 |
| 7,434,661 | B1 * | 10/2008 | Storey | 182/100 |
| 7,753,334 | B2 * | 7/2010 | Schreiber | 248/351 |
| 2002/0003061 | A1 * | 1/2002 | Philippe | 182/82 |
| 2006/0243523 | A1 * | 11/2006 | Curtin | 182/82 |
| 2006/0243524 | A1 * | 11/2006 | Jarrell | 182/82 |
| 2011/0147122 | A1 * | 6/2011 | Canham et al. | 182/150 |

* cited by examiner

*Primary Examiner* — David Bryant
*Assistant Examiner* — Ruth G Hidalgo-Hernande
(74) *Attorney, Agent, or Firm* — Tod R. Nissle, P.C.

(57) ABSTRACT

A scaffold assembly permits a single individual to install the assembly on an open stud wall. The assembly includes a horizontally oriented walkway supporting member, a vertically oriented rail support member, and a support unit extending from the walkway supporting member to the ground. An attachment assembly is connected to the walkway supporting member and includes a pair of rotatable members, one of which bears against the outer edges of a pair of adjacent studs and the other of which bears against the inner edges of the adjacent pair of studs in order to secure the scaffold assembly in place.

1 Claim, 4 Drawing Sheets

UNITARY SAFETY SCAFFOLDING AND METHOD FOR ONE INDIVIDUAL TO INSTALL THE SAME

This application claims priority on U.S. Provisional Patent Application Ser. No. 61/634,218, filed Feb. 24, 2012.

This invention relates to scaffolding.

More particularly, the invention relates to a scaffold support assembly which can be installed by a single individual.

A long existing motivation in connection with scaffolding is to provide improved scaffolding systems.

Accordingly, it would be highly desirable to provide an improved scaffolding system.

Therefore it is a principal object of the invention to provide an improved scaffolding system and method for installing the same.

This and other, further and more specific objects of the invention will be apparent to those skilled in the art from the following detailed description thereof, taken in conjunction with the drawings, in which.

Figure 1:
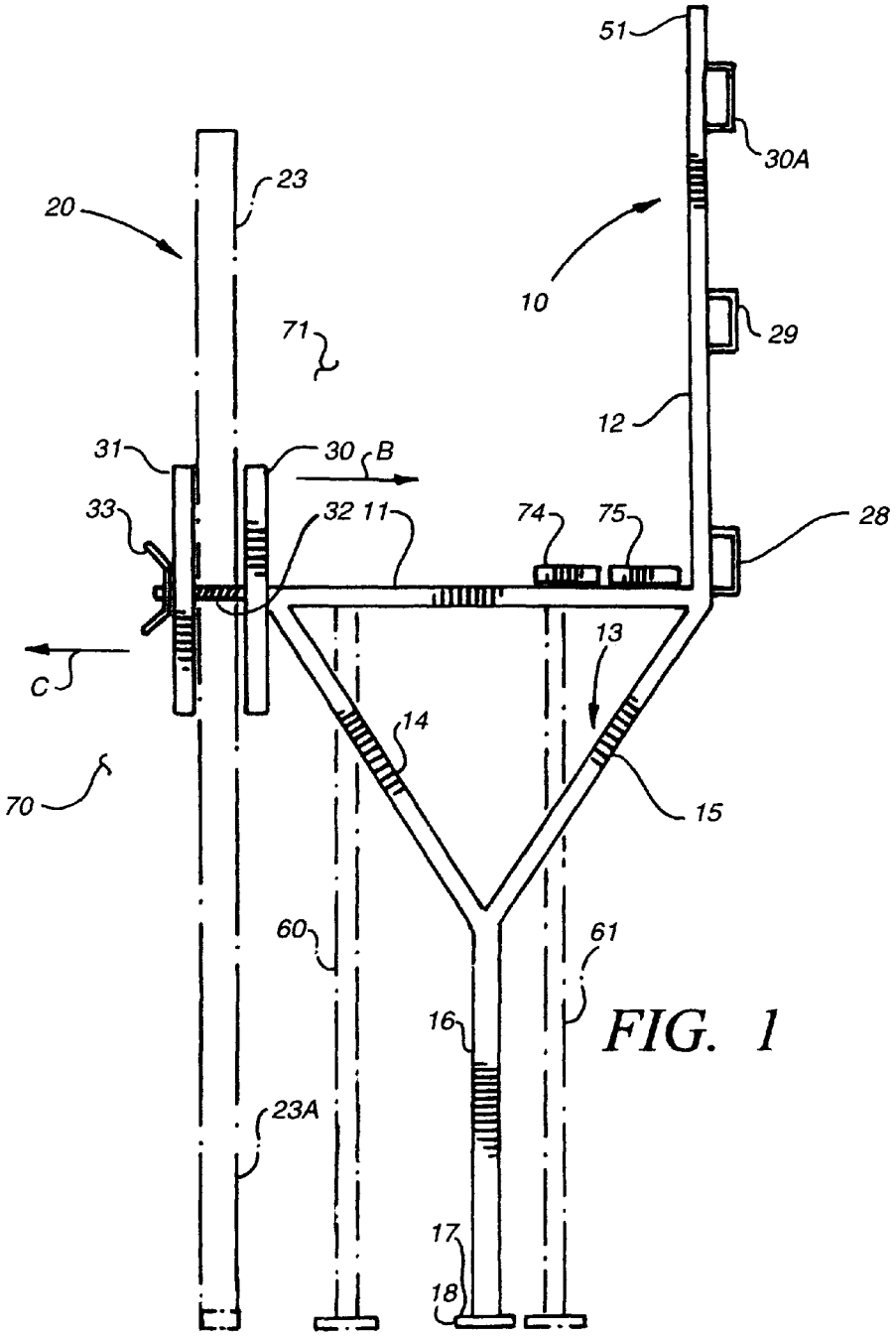
FIG. 1 is a side elevation view illustrating a scaffold support assembly constructed in accordance with the principles of the invention and illustrating the mode of operation thereof.

Briefly, in accordance with the invention, I provide an improved method for a single individual to install a scaffold support assembly on an open stud wall. The open stud wall includes an inner side; an outer side; a plurality of vertically oriented studs each spaced apart a selected distance, and, a horizontally oriented plate extending between the studs. The improved method includes the step of providing a unitary scaffold assembly. The unitary scaffold assembly includes a first horizontally oriented elongate platform support member having a proximate end and a distal end; a second vertically oriented elongate rail supporting member having an upper end and a lower end connected to the distal end of the first member; an elongate ground engaging support unit connected to the first member, having a foot, and shaped and dimensioned to extend from the first member to the ground such that the foot contacts the ground; a third member extending outwardly from the proximate end of the first member and a distance sufficient to span from the outer side of the stud wall to and past the inner side of the stud wall; a fourth member adjustably mounted on the third member to be moved along the third member toward and away from the first member to a plurality of positions along the third member; a fifth member rotatably mounted on the third member between the fourth member and the first member and having a length greater than the selected distance; and, a sixth elongate member between the fifth member and the first member, rotatably mounted on the third member, and having a length greater than the selected distance. The fifth and sixth members are each movable between at least two operative positions, a first operative position generally coplanar with the first, second, and third members, and, a second operative position generally perpendicular to the first, second, and third members. The first, second, third, fifth and sixth members, along with the support unit, generally collectively lie in a common plane when the fifth and sixth members are in the first operative position. The method also includes the steps of positioning the scaffold assembly on the inner side of the stud wall with the fifth and sixth members in the first operative position; moving the scaffold assembly between a selected adjacent pair of studs toward the outer side of the stud wall, each of the selected adjacent pair of studs having an outer edge on the outer side of the stud wall and having an inner edge on the inner side of the stud wall; placing the bottom end of the support unit on the ground such that the sixth member is located on the outer side of the stud wall and the fifth member is located on the inner side of the stud wall; rotating the sixth member to the second operative position on the outer side of the wall; rotating the fifth member to the second operative position on the inner side of the wall; and, moving the fourth member along the third member to press the sixth member against the outer edges of the selected adjacent pair of studs, and the fifth member against the inner edges of the selected adjacent pair of studs.

Figure 2:
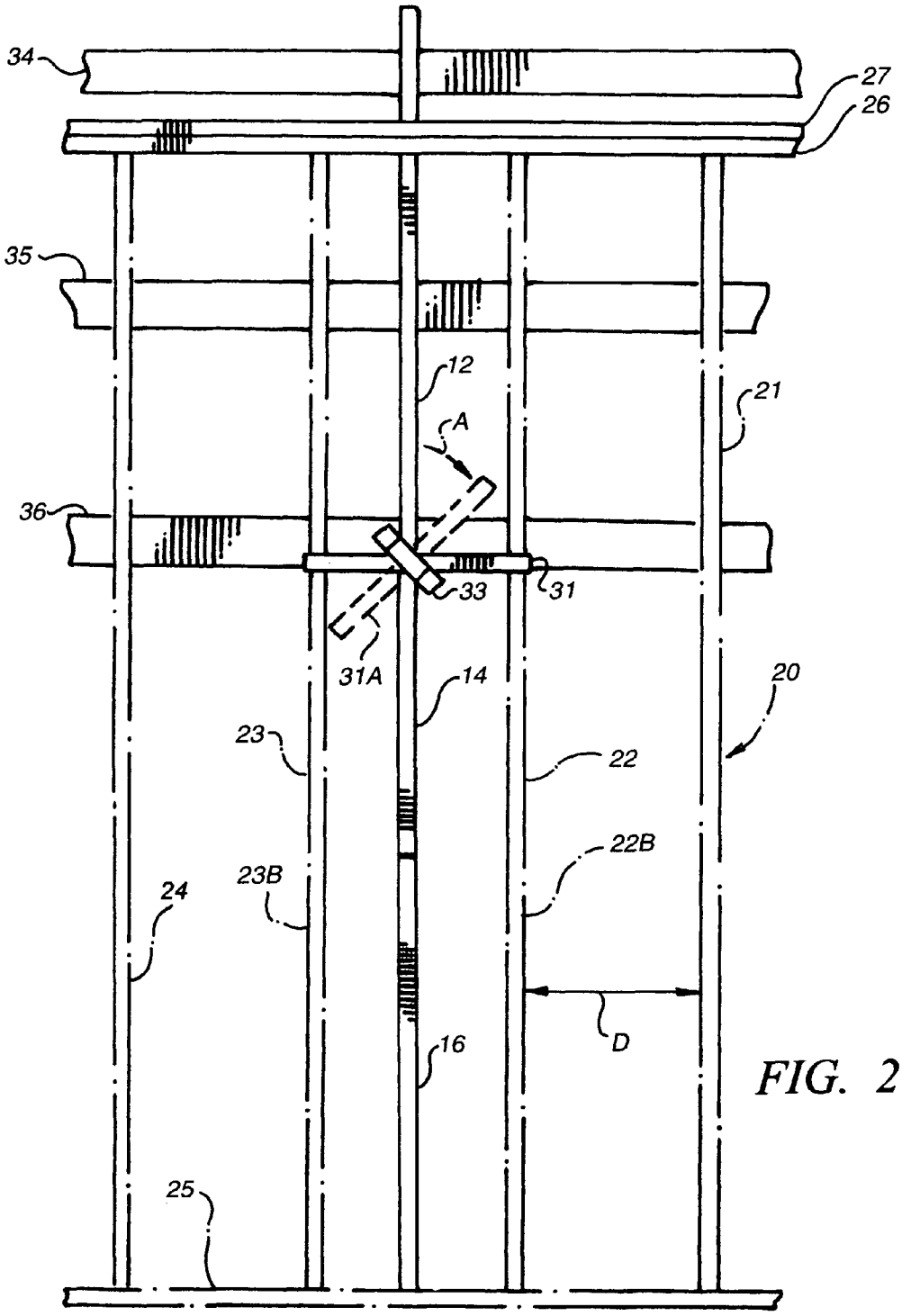
FIG. 2 is a front elevation view further illustrating the scaffold support assembly of FIG. 1 installed in an open stud wall.

Turning now to the drawings, which depict the presently preferred embodiments of the invention for the purpose of illustration thereof, and not by way of limitation of the invention, and in which like characters refer to corresponding elements throughout the several views, FIGS. 1 and 2 illustrate a unitary scaffold assembly 10 and method for installing the same in accordance with the invention. The open stud wall 20 includes an inner side 70, an outer side 71, a plurality of vertically oriented studs 21, 22, 23, 24 each spaced apart a selected distance D (FIG. 2) from an adjacent stud, and a horizontally oriented bottom plate 25 extending between the studs.

Bottom plate 25 rests on the foundation of the building structure being constructed and also extends beneath the lower ends of studs 21 to 24. In another embodiment of the invention, a separate plate 25 rests on the foundation of a building structure being constructed and extends laterally between each pair of adjacent of studs, but is not located beneath the lower ends of the pair of studs. Instead, the lower ends of the studs contact or are immediately adjacent the foundation.

The unitary scaffold assembly 10 includes a first horizontally oriented elongate platform support member 11 having a proximate end and a distal end; a second vertically oriented elongate rail supporting member 12 having an upper end 51 and a lower end connected to the distal end of the first member 11; and, an elongate ground engaging support unit 13 connected to the first member 11. Member 11 is preferably, but not necessarily, fixedly connected to member 12. The ground engaging unit includes members 14, 15, 16 and foot 17. The shape and dimension of foot 17 can vary as desired. Foot 17 is, as depicted in FIG. 1 located at the bottom of member 16. Horizontally oriented members 26, 27 extend along the top of studs 21 to 24. The height of the open stud wall is typically about eight feet or about nine feet, although such height can vary as desired. Member 26 is a top plate. Member 27 is a double plate.

As would be appreciated by those of skill in the art, at least two spaced apart unitary scaffold assemblies 10 are installed along an open stud wall so that a plurality of horizontally oriented walkway boards 74, 75 can be installed on the assemblies 10 and span or extend from support member 11 of one assembly 10 to the support member 11 of the other spaced apart assembly 10. Similarly, a horizontally oriented board or other railing 34 can be slidably installed through the bracket 30A of one assembly 10 and span or extend from that bracket 30A to and through the bracket 30A of the other assembly 10. A horizontally oriented board or other railing 35 can be slidably installed through the bracket 29 of one assembly 10 and span or extend from that bracket 29 to and through the bracket 29 of the other assembly 10. And, a horizontally oriented board or other railing 36 can be slidably installed through the bracket 28 of one assembly 10 and span or extend from that bracket 28 to and through the bracket 28 of the other assembly 10. FIG. 2 illustrates such railings 34 to 36 installed, although only a single assembly 10 is visible in FIG. 2.

The ground engaging unit 13 can be constructed in any desired manner as long as it spans the distance between member 11 and the ground 18 and sufficiently supports members 11 and 12, any walk way boards 74 and 75, and any railings 34, 35, 36 extending through U-shaped brackets 28, 29 30A fixedly secured to member 12. The construction of unit 13 illustrated in FIG. 1 is one preferred embodiment of unit 13, in part because it tends to balance the weight of assembly 10. In an alternate embodiment of unit 13, members 14, 15, 16 are eliminated and are replaced by members 60 and 61, each of which extends to the ground and includes a foot. In another embodiment of unit 13, members 14, 15, 16 are eliminated and only member 61 is utilized. In a further embodiment of unit 13, members 14 and 15 are utilized in the manner illustrated in FIGS. 1 and 3, but member 16 is eliminated and replaced by members 62 and 63 (FIG. 3), wherein members 62 and 63 each include a ground contacting foot. In still another embodiment of the invention, members 14 and 15 are utilized in the manner illustrated in FIGS. 1 and 3, but member 16 is eliminated and replaced only with member 62, wherein member 62 includes a ground contacting foot. The point at which a foot 17 contacts the ground can vary as desired. In many applications of the assembly 10, a foot 17 contacts the ground at a point spaced outwardly apart from the periphery of a foundation on which an open stud wall 20 is constructed. In other applications of the assembly 10, a foot 17 may contact the ground at a point on the foundation or floor on which wall 20 is constructed. For example, an assembly 10 can be utilized to erect scaffolding along an open stud wall that is located on the interior of the foundation. Consequently, as used herein, the term ground encompasses ground or earth outside the periphery of the foundation of a building, encompasses the foundation, or floor, on which an open stud wall is constructed, and encompasses a supplemental ground or foundation based structure. Examples of a supplemental ground structure and a supplemental foundation based structure include a sidewalk constructed on the ground and a horizontally oriented plate attached to a floor, respectively.

By way example, and not limitation, the foundation for an open stud wall can comprise a concrete slab, which is typically the case on the ground floor of a building structure, particularly a residential structure. The foundation of the second, third, fourth, etc. stories in a commercial building can also comprise a floor consisting of a concrete slab. On the other hand, the foundation of a ground floor or of a second, third, fourth, etc. story floor can also comprise horizontally oriented spaced apart wood beams, for example two by twelve wood beams, covered by plywood sheets fastened to the wood beams. Another foundation construction comprises horizontally oriented spaced apart metal beams covered with plywood or some other flooring material. Regardless of the materials utilized to construct a foundation, the foundation serves the function of providing a base or support for an open stud wall.

Foot 17 can simply comprise the bottom of a member 16. A member 14, 15, 16, 60 to 63 can telescope or otherwise be adjustable so the length of the member can be adjusted as desired.

Assembly 10 includes a third externally threaded member 32 extending outwardly from the proximate end of the first member and a distance sufficient to span from the outer side of the stud wall to and past the inner side of the stud wall; includes a fourth internally threaded member 33 adjustably mounted on the third member 32 to be moved along the third member 32 toward and away from the first member 11 to a plurality of positions along the third member; includes a fifth member 31 rotatably mounted on the third member 32 between the fourth member 33 and the first member 11 and having a length greater than the selected distance between an adjacent pair of studs; and, includes a sixth elongate member 30 between said fifth member 31 and the first member 11, rotatably mounted on the third member 32, and having a length greater than the selected distance between an adjacent pair of studs. Member 11 functions as a stop for sixth member 30 and in FIG. 1 prevents member 30 from moving any further in the direction of arrow B. On the other hand, in FIG. 1 vertically oriented member 30 can slide in the direction of arrow C until it contacts vertically oriented member 31. In an alternate embodiment of the invention, member 30 is mounted on member 32 both so that member 30 can rotate about member 32, and, so that at the same time rotatable member 32 is prevented from moving laterally on member 32 in the direction of either arrow B or arrow C. Note that in FIG. 1 there is not a stud 20 to 24 positioned between members 30 and 31. Also, in FIG. 1 vertically oriented member 31 can, since there is not a stud extending between members 30 and 31, be slid along member 32 in the direction of arrow B until member 31 contacts vertically oriented member 30.

The fifth 31 and sixth 30 members are each movable between at least two operative positions, a first vertically oriented operative position generally coplanar with said first 11, second 12, and third 32 members, and a second horizontally oriented operative position generally perpendicular to the first 11, second 12, and third 32 members. FIG. 1 illustrates members 30 and 31 in the first operative position. FIG. 2 illustrates members 30 and 31 in the second operative position. In the first operative position, members 30 and 31 may be somewhat canted from the vertical, but must be sufficiently vertical to fit through the space, indicating by arrows D in FIG. 2, between an adjacent pair 22-23 of vertically oriented studs. Although the distance between each adjacent pair of studs can vary, the distance D (FIG. 2) between a first adjacent pair 21-22 of studs is typically equal to the distance between other adjacent pairs 22-23, 23-24 of studs in an open stud wall. As is illustrated in FIG. 2, the length of each member 30 and 31 is greater than distance D, this so that when members 30 and 31 are in the second operative position, the ends of members 30 and 31 bear against the outer and inner edges, respectively, of studs 22 and 23.

The first 11, second 12, third 32, fifth 31 and sixth 30 members, along with the support unit 13, generally collectively lie in a common plane when said fifth 31 and sixth 30 members are in the first operative position. Members 11, 12, 14, 15, 16, 30, 31 preferably each comprise a length of tubular steel or other material such that the cross-sectional shape and dimension of each of said members 11, 12, 14, 15, 16, 30, 31 is equivalent. When the cross-sectional shape and dimension of each of said members 11, 12, 14, 15, 16, 30, 31 is the same and members 30 and 31 and 33 are in the vertical orientation illustrated in FIG. 1, multiple assemblies 10 are readily stacked one on top of the other and take up a minimal amount of storage space, which is one of the virtues of the assemblies 10 of the invention. Each assembly 10 does not include walk way boards 74 and 75 or include railings 34 to 36. The walk way boards 74 and 75 and railings 34 to 36 are installed after assemblies 10 are installed in an open stud wall.

In use, an individual carries an assembly 10 to the inner side 70 of an open stud wall 20. The individual holds assembly 10 in an upright orientation generally equivalent to that shown in FIGS. 1 and 2. The individual insures that members 30 and 31 are the first operative position, i.e., are generally vertically oriented in the manner illustrated in FIG. 1 so that members 31 and 30 will fit in the space between an adjacent pair of studs 22 and 23. The individual lifts assembly 10 and moves it between studs 22 and 23 to a position equivalent to that illustrated in FIG. 1 with foot 17 of member 16 contacting the ground 18. The individual then rotates members 31 and 30 in the direction of arrow A (FIG. 2) to a horizontally oriented position such that member 30 is adjacent the outer edges 23A of studs 22 and 23 and member 31 is adjacent the inner edges 22B, 23B of studs 22 and 23 in the manner illustrated in FIG. 2. Internally threaded member 33 is turned along externally threaded member 32 to move member 33 in the direction of arrow B and compress member 31 against inner edges 22B, 23B and member 30 against outer edges 23A. Turning member 33 to move it in the direction of arrow B forces and tightens member 33 against member 31, which in turn compresses studs 22 and 23 intermediate members 31 and 30. Members 31 and 30 have apertures formed therethrough which permit members 31 and 30 to slide along (and rotate about) member 32. While in the current embodiment of the invention, member 32 is externally threaded and member 33 is internally threaded, other constructs can be utilized to permit the position of member 33 along member 32 to be adjusted. For example, member 33 can include a set screw which is tightened after member 33 is pressed against member 31 to compress studs 22 and 23 between the ends of members 31 and 30. Or, members 33 and 32 can be shaped and dimensioned to function as a bayonet mount. Or member 32 can include teeth and member 33 can include a locking ratchet head in the manner of a cable strap, except that the locking ratchet head can be disengaged from the teeth. And so on. Once members 31 and 30 are in the second operative position illustrated in FIG. 2, they can, if desired, be screwed to studs 22 and 23 to further detachably secure members 31 and 30 in place. Similarly, foot 17 can be screwed or otherwise detachably fastened to the ground to help maintain it in place.

After an individual (or more than one individual, if desired) installs two or more spaced apart assemblies 10 along an open stud wall, the individual installs the rail(s) 34 to 36 and the walkway board(s) 74 and 75 to extend from one assembly 10 to the other assembly 10. Boards 74 and 75 normally are installed before rails 34 to 36 so that an individual can walk along boards 74 and 75 while installing rails 34 to 36.

Figure 3:
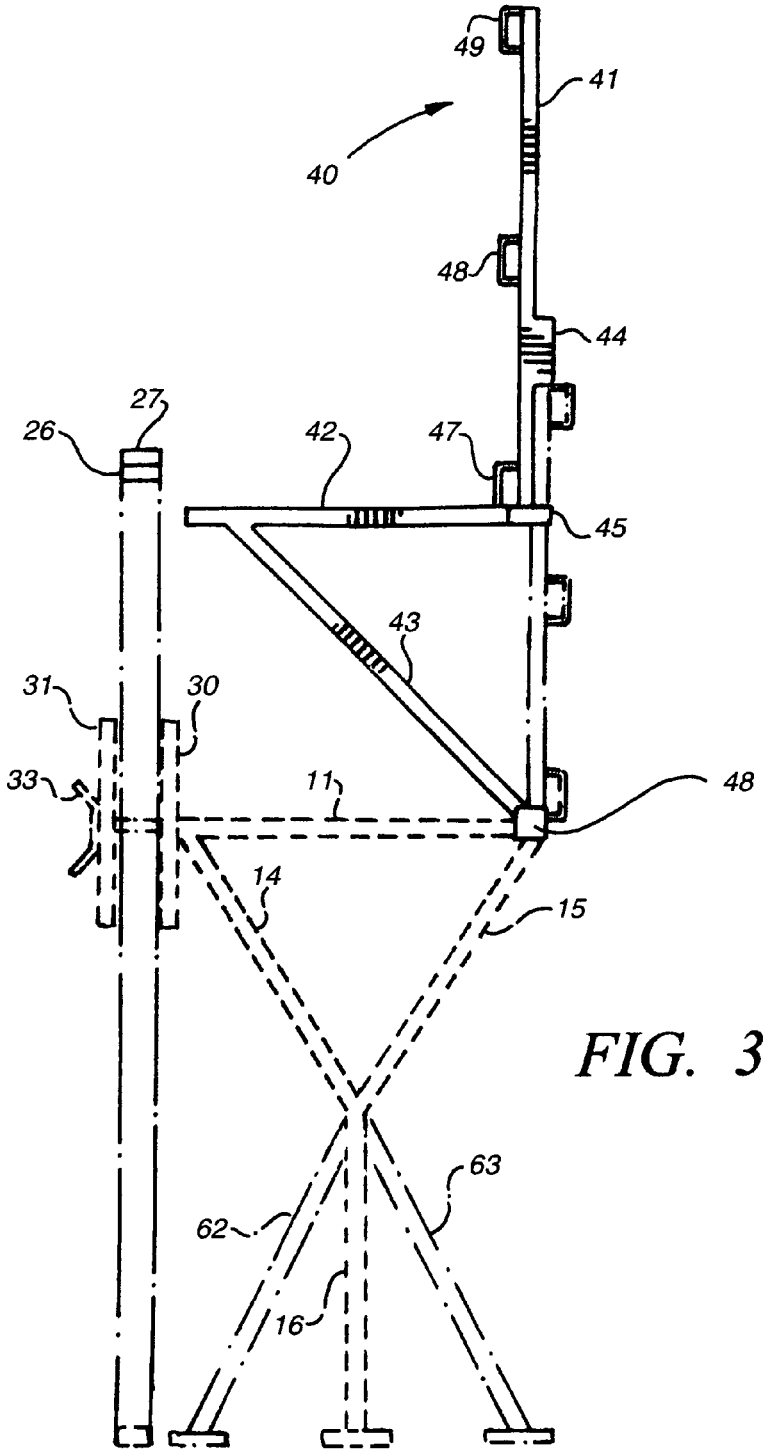
FIG. 3 is a side elevation view illustrating a supplemental scaffold support assembly utilized in conjunction with the scaffold support assembly of FIGS. 1 and 2; and, FIG. 4 is a perspective view further illustrating the supplemental scaffold support assembly of FIG. 3.
Figure 4:
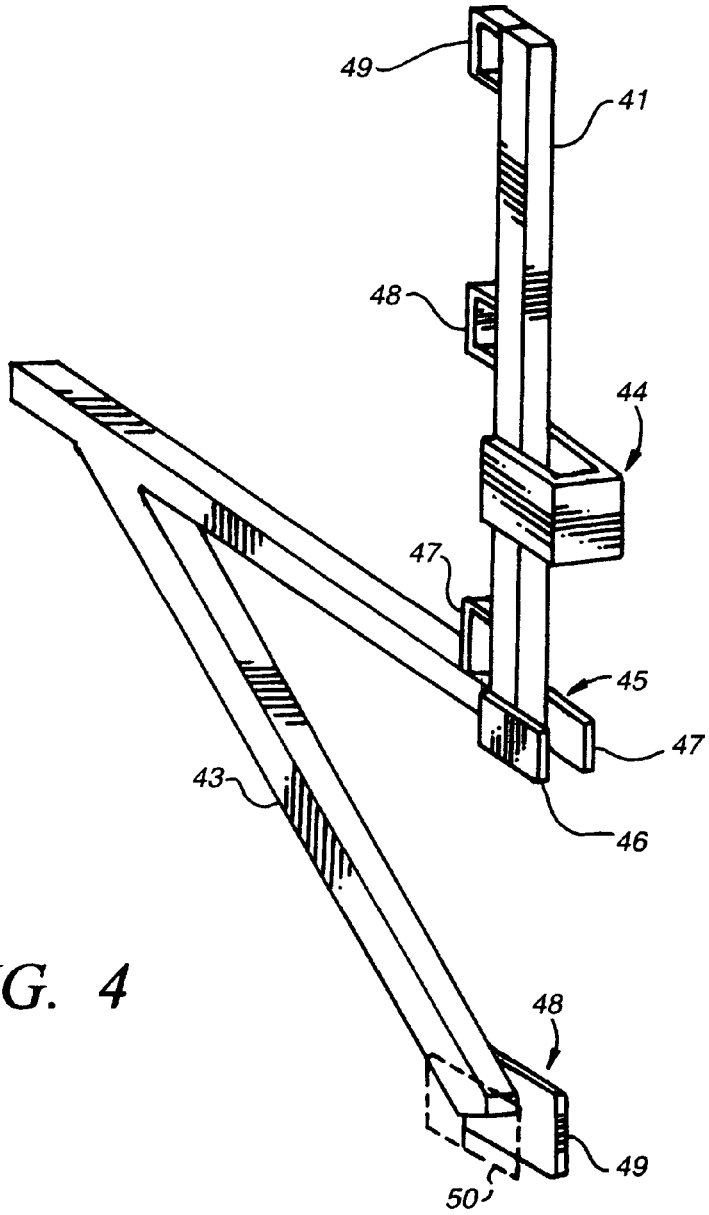

FIGS. 3 and 4 illustrate a supplemental scaffold assembly 40 that is, if desired, utilized in conjunction with an assembly 10. Assembly 40 includes horizontally oriented platform support member 42, vertically oriented rail support member 41, and support member 43. The lower end of member 41 is fixedly secured to the outer, or distal, end of member 42. The upper end of member 43 is fixedly secured to the inner, or proximate, end of member 42. Sleeves 47, 48, 49 are fixedly secured to the inner side of member 41. Sleeve 44 is fixedly secured to the outer side of member 41. Sleeve 44 is shaped and dimensioned to slide, when assembly 40 is mounted on assembly 10, over and engage the upper end 51 of member 12 (FIG. 1). A pair 45 of plates or fingers 46, 47 (FIG. 4) are fixedly secured to member 42 and are spaced apart to slide, when assembly 40 is mounted on assembly 10, over edges of member 12 in the manner illustrated in FIG. 3. A pair 48 of plates or fingers 49 and 50 (FIG. 4) are fixedly secured to member 43 and are spaced apart to slide, when assembly 40 is mounted on assembly 10, over the edges of members 11 and 12 at the juncture of members 11 and 12 in the manner illustrated in FIG. 3.

As noted, after an assembly 10 is installed on an open stud wall, assembly 40 is installed on assembly 10 by sliding sleeve 44 downwardly over upper end 51, by sliding fingers 46 and 47 over the slides of member 12, and by sliding fingers 49 and 50 over the juncture of members 11 and 12. FIG. 3 illustrates the installation of assembly 40 on assembly 10.

Once at least a pair of vertically oriented spaced apart assemblies 40 is installed on a pair of spaced apart vertically oriented assemblies 10, horizontally oriented walkway boards are placed on and extend between spaced apart members 42 of the pair of assemblies 40, and, horizontally oriented railings, comparable to railings 34 to 36, are slid through and extend between each pair of sleeves in the assemblies 40. One railing is slid through sleeves 49; another through sleeves 48; and, a third railing through sleeves 47.

Assembly 40 permits the height of scaffolding walkway boards to be increased to facilitate working on the roof of a building.

The cross section shape and dimension of each member 41, 42, 43 is preferably equivalent to facilitate stacking and storing a plurality of assemblies 40.

By way of example, and not limitation, the height of assembly 10, which height extends from the bottom of foot 17 to the top of member 12, is presently one hundred and nine inches; the height from the bottom of foot 17 to the top of bracket 30 is presently one hundred and three inches; and the height from the bottom of foot 17 to the upper surface of horizontally oriented member 11 is presently sixty-one inches. In FIG. 1, walkway boards 74 and 75 each lie on and contact the upper surface of member 11. The height of assembly 40 from the bottom of member 43 to the top of member 41 is presently seventy-eight inches. The height, or distance, from the bottom of member 43 to the upper surface of member 42 is presently thirty inches. Horizontally oriented walkway boards (not shown) lie on and contact the upper surface of member 42 in the same manner that boards 74 and 75 lie on and contact the upper surface of member 11.

One particular advantage of unitary assembly 10 is that it can be installed on an open stud wall 20 without requiring the use of any additional parts or tools. A further advantage of the assembly 10 is that it can be installed without requiring the individual who is installing the assembly 10 to lean very far—if at all—outwardly from the inner side 70 to the outer side 71 of an open stud wall 20.

In one presently preferred embodiment members 11, 12, 13, 14, 16 and 32 are all welded or otherwise fixedly connected together in the manner illustrated i FIG. 1. After members 30, 31, and 33 are then mounted on member 32, a self-contained, unitary assembly 10 is produced which can, as earlier described, be installed by a single individual on an open stud wall 20.

Having described the invention and presently preferred embodiments and the best modes thereof in such terms as to enable one of skill in the art to make and use the invention,

We claim:

1. A method for a single individual to install a scaffold support assembly on an open stud wall, the wall including an inner side, an outer side, a plurality of vertically oriented studs each spaced apart a selected distance, a horizontally oriented plate extending between the studs, the method comprising the steps of (a) providing a unitary scaffold assembly including (i) a first horizontally oriented elongate platform support member having a proximate end and a distal end, (ii) a second vertically oriented elongate rail supporting member having an upper end and a lower end connected to said distal end of said first member, (iii) an elongate ground engaging support unit connected to said first member, having a foot, and shaped and dimensioned to extend from said first member to the ground such that said foot contacts the ground, (iv) a third member extending outwardly from said proximate end of said first member and a distance sufficient to span from the outer side of the stud wall to and past the inner side of the stud wall, (v) a fourth member adjustably mounted on said third member to be moved along said third member toward and away from said first member to a plurality of positions along said third member, (vi) a fifth member rotatably mounted on said third member between said fourth member and said first member and having a length greater than said selected distance, (vi) a sixth elongate member between said fifth member and said first member, rotatably mounted on said third member, and having a length greater than said selected distance, said fifth and sixth members each movable between at least two operative positions, (vii) a first operative position generally coplanar with said first, second, and third members, and (viii) a second operative position generally perpendicular to said first, second, and third members;

said first, second, third, fifth and sixth members, along with said support unit, generally collectively lying in a common plane when said fifth and sixth members are in said first operative position;

(b) positioning said scaffold assembly on the inner side of the stud wall with said fifth and sixth members in said first operative position;

(c) moving said scaffold assembly between a selected adjacent pair of studs toward the outer side of the stud wall, each of the selected adjacent pair of studs having an outer edge on the outer side of the stud wall and having an inner edge on the inner side of the stud wall;

(d) placing said bottom end of said support unit on the ground such that said sixth member is located on the outer side of the stud wall and said fifth member is located on the inner side of the stud wall;

(e) rotating said sixth member to said second operative position on the outer side of the wall;

(f) rotating said fifth member to said second operative position on the inner side of the wall; and, (g) moving said fourth member along said third member to press (i) said sixth member against the outer edges of the selected adjacent pair of studs, and (ii) said fifth member against the inner edges of the selected adjacent pair of studs.

* * * * *